US007273161B2

(12) United States Patent
Fogle et al.

(10) Patent No.: US 7,273,161 B2
(45) **Date of Patent: *Sep. 25, 2007**

(54) CARTON WITH A DISPENSER IN THE TOP PANEL FOR DISPENSING POUCHES

(75) Inventors: James C. Fogle, Marietta, GA (US); Raymond R. Spivey, Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 140 days.

This patent is subject to a terminal disclaimer.

(21) Appl. No.: 11/046,691

(22) Filed: Jan. 31, 2005

(65) Prior Publication Data

US 2005/0199688 A1 Sep. 15, 2005

Related U.S. Application Data

(63) Continuation of application No. 10/271,447, filed on Oct. 16, 2002, now Pat. No. 6,866,186.

(51) Int. Cl.
*B65D 5/46* (2006.01)

(52) U.S. Cl. ..... 229/117.13; 229/242

(58) Field of Classification Search ..... 229/117.13, 229/242, 117.26; 206/141, 427, 428
See application file for complete search history.

(56) References Cited

U.S. PATENT DOCUMENTS 2,669,351 A * 2/1954 Carson et al. ..... 206/526
3,078,032 A 2/1963 Robinson et al.
4,155,449 A 5/1979 Bryne
4,222,485 A 9/1980 Focke
4,256,226 A 3/1981 Stone
4,318,474 A 3/1982 Hasegawa
4,376,509 A 3/1983 Schaffer
4,605,128 A 8/1986 Rieke
4,817,866 A * 4/1989 Wonnacott ..... 206/427
5,794,778 A * 8/1998 Harris ..... 206/428
5,927,498 A * 7/1999 Saam ..... 206/499
6,896,130 B2 * 5/2005 Theelen ..... 206/175

FOREIGN PATENT DOCUMENTS

GB 0202809 * 2/2002

* cited by examiner

*Primary Examiner*—Tri M. Mai
(74) *Attorney, Agent, or Firm*—Womble Carlyle Sandridge & Rice, PLLC

(57) ABSTRACT

A carton is provided for carrying a plurality of pouches which has at least one dispenser in the top panel formed between the handle and the end panel. The carton may have two dispensers, with one formed on each side of the handle between the handle and an end panel. The dispenser is sized so that only one pouch can be dispensed at a time from each row of pouches. The loaded carton can be carried by the handle after a dispenser has been opened.

16 Claims, 4 Drawing Sheets

CARTON WITH A DISPENSER IN THE TOP PANEL FOR DISPENSING POUCHES

CROSS-REFERENCE TO RELATED APPLICATION

This application is a continuation of U.S. patent application Ser. No. 10/271,447 filed Oct. 16, 2002 now U.S. Pat. No. 6,866,186, which is incorporated herein by reference in its entirety.

FIELD OF THE INVENTION

This invention relates generally to a carton with a handle that has at least one dispenser in the top panel for dispensing pouches containing drinks one at a time from each row of pouches.

BACKGROUND OF THE INVENTION

Pouches made out of metal foil and plastic have become popular for carrying drinks. A number of these pouches can be carried in a carton, but the removal of one pouch results in the destruction of the carton. It would be desirable to have a carton that could dispense these pouches one at a time, but yet remain intact for future dispensing or for carrying. These cartons typically contain ten pouches in two rows of five pouches each.

SUMMARY OF THE INVENTION

It is an object of this invention to provide a carton that will carry a multiple number of drink pouches which can be dispensed one at a time. It is the further object of this invention to develop a carton with a dispenser that can be carried by the handle after one or more dispenser flaps has been removed.

The objects of this invention have been achieved by providing a carton that has at least one dispenser in the top panel and has a handle in the top panel for carrying. The dispenser can be opened by tearing the dispenser flap in the top panel open along the tear lines provided in the carton. The dispenser can be constructed so that it will only dispense one pouch at a time from each row or only one pouch at a time depending upon the size of the pouch and dispenser. A tab can be provided on the end of the dispenser flap for the easy removal of the dispenser flap. In another embodiment of this invention, two dispensers are provided, with a dispenser on each side of a handle in the center of the top panel. Cartons can be constructed with one or more dispenser flaps using a variety of handles for carrying cartons. It is preferred that the length of the handle be perpendicular to the side panels of the carton.

These and other objects, features, and advantages of the present invention will become more apparent upon reading the following specification in conjunctions with the accompanying drawing figures.

DETAILED DESCRIPTION OF THE PREFERRED EMBODIMENTS

Figure 1:
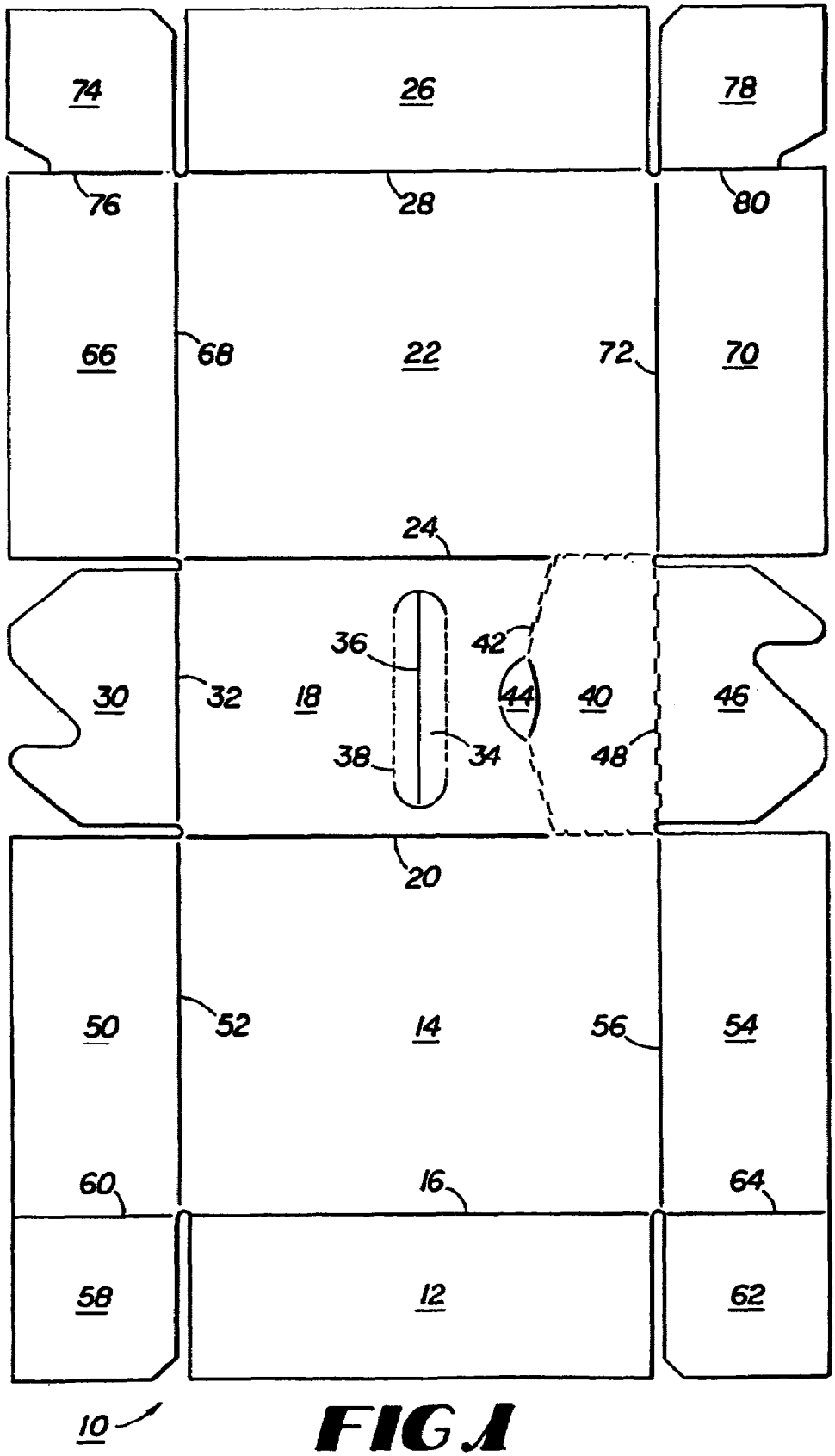
FIG. 1 is a plan view of a carton of the present invention which has a single dispenser in the top panel and a handle.

The present invention is intended primary for use with pouches used to contain drinks such as orange juice, milk, and fruit drinks. The present invention provides a carton for containing the plurality of these pouches (e.g. 10 or more pouches). The blank 10 as illustrated in FIG. 1 is formed from a foldable sheet of material, such as paperboard. The blank 10 has bottom flap 12 which is attached to a side panel 14 by fold line 16, and in turn attached to a top panel 18 by fold line 20. Top panel 18 is attached to side panel 22 by fold line 24 and in turn attached to bottom flap 26 by fold line 28. The top panel 18 is attached to the top end flap 30 by fold line 32. The top panel 18 has a handle 34 with a cut line 36 in the middle of the handle and fold line 38 on each side of the handle. The top panel 18 has a dispenser flap 40 which can be torn from the top panel along tear line 42. The dispenser flap 40 may have an opening tab 44 to facilitate opening the dispenser. The dispenser flap 40 is attached to top end flap 46 along tear line 48. Side panel 14 is attached to side end flap 50 by fold line 52 and attached to side end flap 54 by fold line 56. Side end flap 50 is attached to bottom end flap 58 by fold line 60 and side end flap 54 is attached to bottom end flap 62 by fold line 64. Side panel 22 is attached to side end flap 66 by fold line 68 and attached to side end flap 70 by fold line 72. Side end flap 66 is attached to bottom end flap 74 by fold line 76. Side end flap 70 is attached to bottom end flap 78 by fold line 80.

This blank can be formed into a carton by folding the blank and gluing bottom flaps 12 and 26 together forming a sleeve into the which the pouches may be loaded and the various flaps on the ends of the carton folded and glued to each other.

Figure 2:
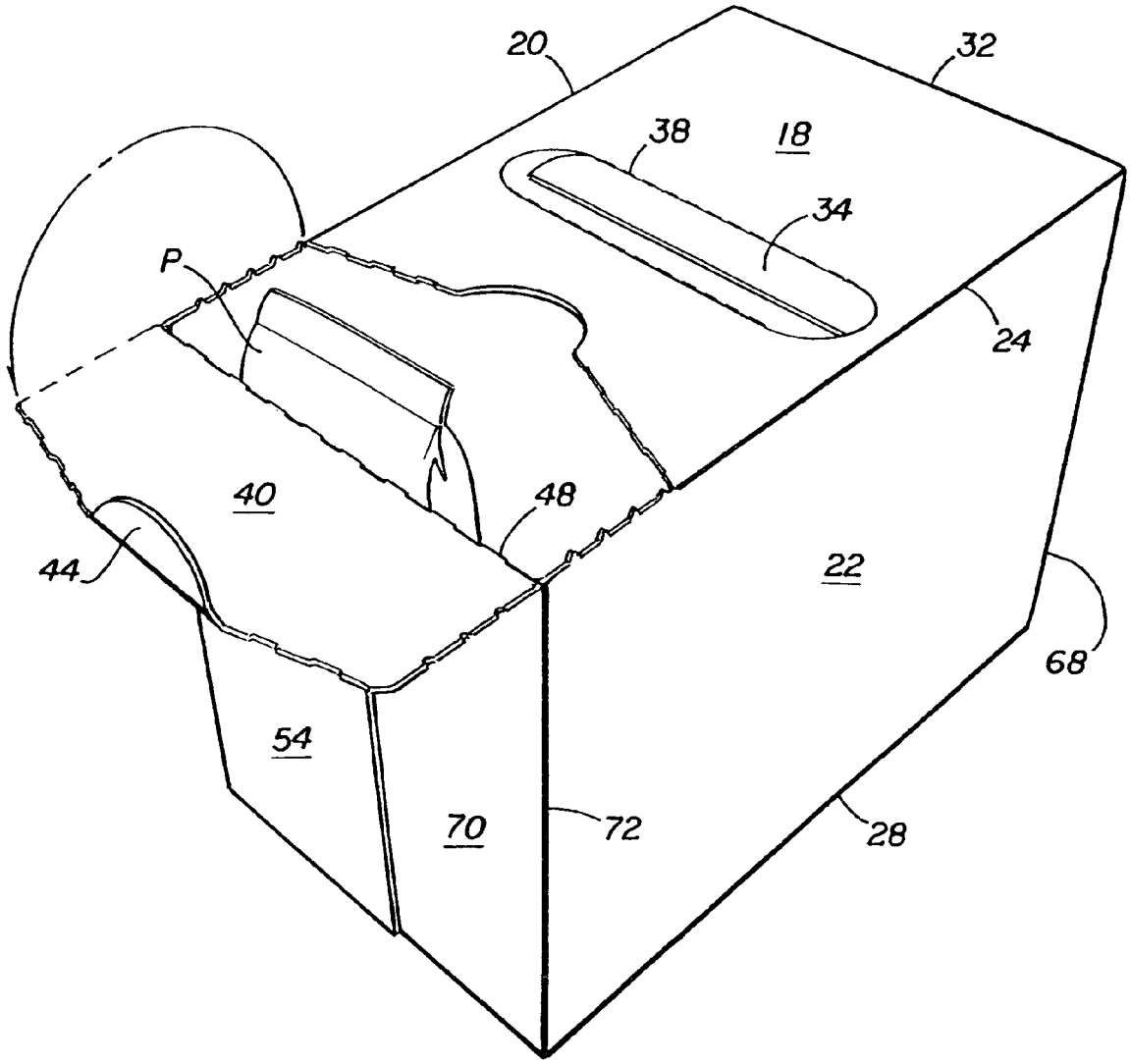
FIG. 2. is a perspective view of a carton made from the blank of FIG. 1 that has been loaded with pouches and the dispenser opened.

This carton is shown in FIG. 2 with a dispenser flap 40 removed forming the dispenser through which the pouches P may be dispensed. This carton can still be carried by the handle 34 even after the dispenser has been opened. This carton dispenser can be constructed so that it will only dispense one pouch at a time. This carton can be used either as a store display or taken home by the consumer to be used as a dispensing carton.

Figure 3:
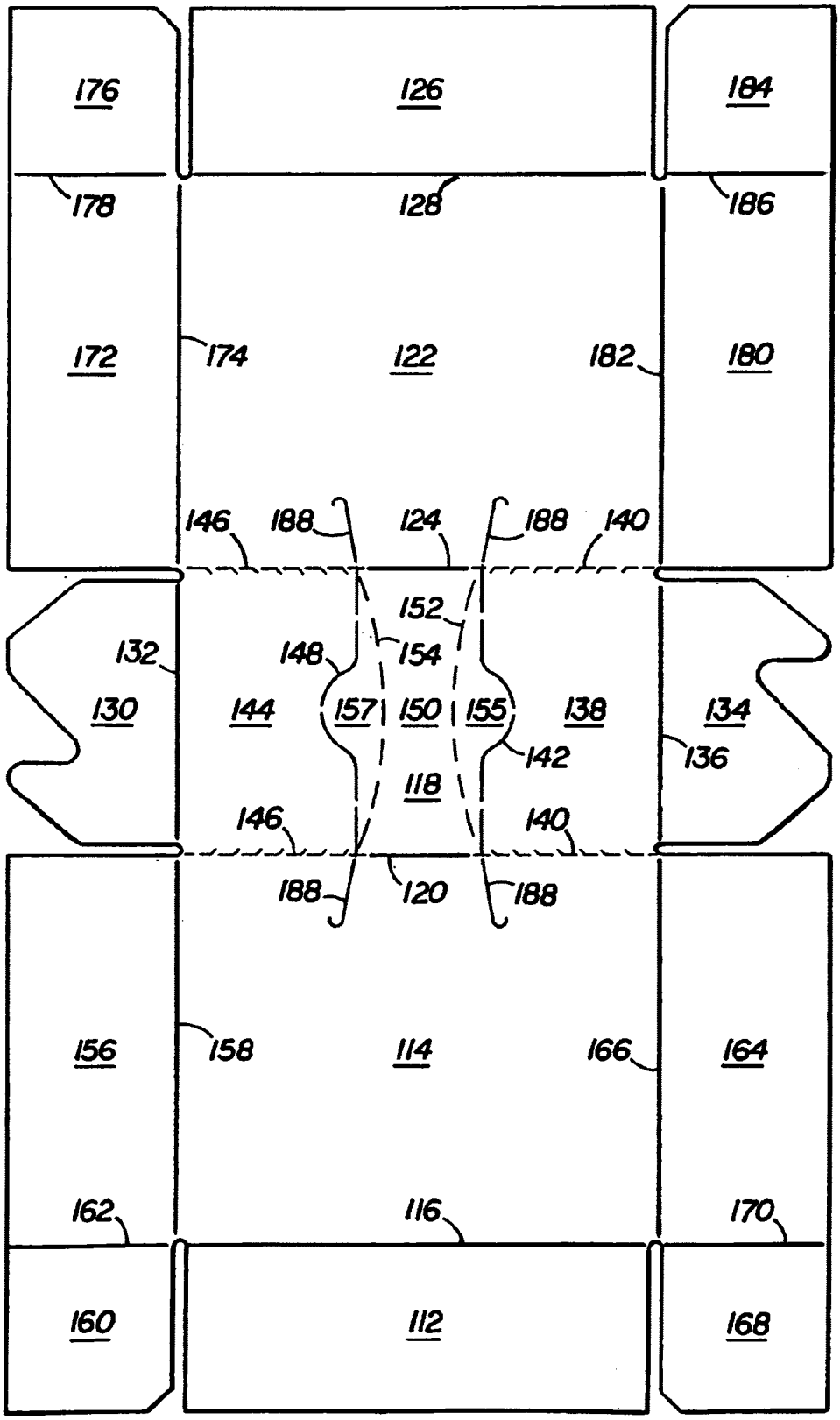
FIG. 3 is a plan view of a carton which has a handle in the top panel and dispenser on each side of the handle.

Another embodiment of this invention is illustrated in FIG. 3 which is a blank having a handle and two dispensers in the top panel. The blank 100 has bottom flap 112 which is connected to side panel 114 by fold line 116 which is connected to top panel 118 by fold line 120 and in turn connected to side panel 122 by fold line 124 and finally connected to bottom flap 126 by fold line 128. Top end flap 130 is connected by fold line 132 to dispenser flap 144. Top end flap 134 is connected by fold line 136 to a second dispenser flap 138. This dispenser flap 138 has tear lines 140 connecting it to side panels 114 and 122. Cut line 142 is provided for easy removal of the dispenser flap 138 from the carton, thus opening the dispenser. Dispenser flap 144 is connected to side panels 114 and 122 by tear line 146 and has cut line 148 for easy removal of the dispenser flap 144. This carton has a curved handle 150 with fold lines 152 and 154 between the handle 150 and handle flaps 155 and 157. Side panel 114 is connected to side end flap 156 by fold line 158 and to side end flap 164 by fold line 166. Side end flap 156 is connected to bottom end flap 160 by fold line 162 and side end flap 164 is connected to bottom end flap 168 by fold line 170. Side panel 122 is connected to side end flap 172 by fold line 174 and to side end flap 180 by fold line 182. Side end flap 172 is connected to bottom end flap 176 by fold line 178 and side end flap 180 is connected to bottom end flap 184 by fold line 186. Slits 188 may be provided in the side panels 122 and 114 to dissipate the stress involved in lifting the carton.

Figure 4:
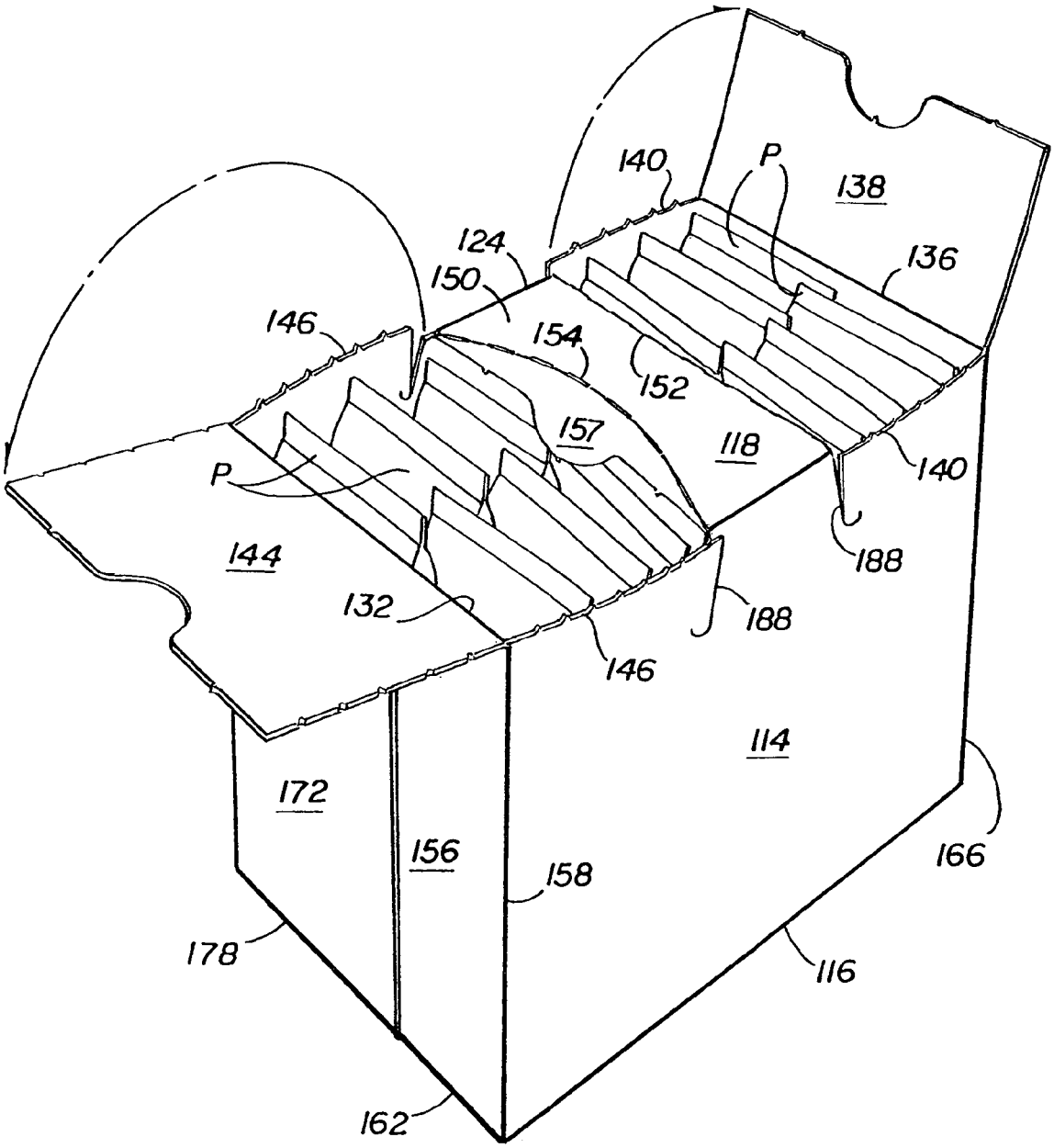
FIG. 4 is a perspective view of the carton made from the blank of FIG. 3 which has been erected and filled with pouches and both dispensers opened.

A carton can be formed from the blank shown in FIG. 3 by folding into a sleeve form and gluing bottom flaps 112 and 126 together and then be loaded with pouches and the various end flaps glued together. A carton erected from the blank shown in FIG. 3 is illustrated in FIG. 4 where the dispenser flaps 138 and 144 have been removed to allow the easy removal of the pouches contained therein.

The different embodiments of the present invention permit the pouches to be removed through a dispenser in the top panel one at a time from each row of pouches or only one at a time if there is only a single row. These cartons also have a handle in the top panel which allows the carton to be carried after a dispenser has been opened.

In order to allow sufficient room for at least one dispenser and to provide adequate strength for carrying the carton, the length of the handle should extend perpendicular to the plane of the two side walls rather than being parallel to the side walls. It is preferred to use a slotted handle that has slits that extend into the side wall for dissipating the stress imposed on the handle. A cut line is usually provided between each dispenser flap and the handle to facilitate the easy removal of the dispenser flap.

While the invention has been disclosed in its preferred forms, it will be apparent to those skilled in the art that many modifications, additions, and deletions can be made therein without departing from the spirit and scope of the invention and its equivalents as set forth in the following claims.

We claim:

1. A carton blank, comprising:

a top panel;

a first side panel connected to said top panel at a first transverse fold line extending across a width of said blank;

a second side panel connected to said top panel at a second transverse fold line on a side of said top panel opposite to said first side panel;

at least one side end flap connected to said first side panel at least one longitudinal fold line extending along a length of said blank;

at least one bottom flap foldably connected to at least one of said side panels;

a first dispenser flap in said top panel defined by a first plurality of tear lines;

a second dispenser flap in said top panel defined by a second plurality of tear lines; and a handle located between said first and second dispenser flaps and having a length extending along said length of said blank, wherein said handle comprises handle flaps contiguous with said handle and connected to said handle by curved fold lines.

2. The blank of claim 1, wherein said handle is biconcave.

3. The blank of claim 1, further comprising at least one slit at each of two ends of said handle, each of said slits extending into one of said first and second side panels.

4. The blank of claim 1, wherein said handle is defined by a plurality of cut lines between said handle and said dispenser flaps.

5. The blank of claim 1, wherein said handle is located substantially symmetrically between said dispenser flaps.

6. The blank of claim 1, further comprising:

a first top end flap foldably connected to said top panel; and a second top end flap foldably connected to said top panel.

7. The blank of claim 1, further comprising a plurality of bottom end flaps, one each being foldably connected to a corresponding side end flap.

8. A carton constructed from said blank of claim 1.

9. The carton of claim 8 and a plurality of pouches contained within said carton.

10. A carton blank, comprising:

a top panel;

a first side panel connected to said top panel at a first transverse fold line;

a second side panel connected to said top panel at a second transverse fold line on a side of said top panel opposite to said first side panel;

at least one bottom panel;

at least one first end flap extending along a first marginal area of the said blank;

at least one second end flap extending along a second marginal area of said blank;

a first dispenser flap in said top panel and defined at least in part by a first plurality of tear lines; and a handle located in said top panel and having a length extending along a length of said blank, wherein said handle comprises a first handle flap defined in part by a first curved fold line, and a second handle flap defined in part by a second curved fold line, the first and second curved fold lines having concave sides facing away from one another.

11. The blank of claim 10, further comprising at least one slit at a first end of said handle, the at least one slit extending into the first side panel.

12. The blank of claim 10, wherein said first dispenser flap is adjacent to said first handle flap.

13. The blank of claim 12, wherein said first handle flap is defined at least in part by a first plurality of cut lines between said first handle flap and said first dispenser flap.

14. The blank of claim 10, wherein one of said first plurality of tear lines defining said first dispenser flap extends along said first transverse fold line and another of said tear lines extends along said second transverse fold line.

15. The blank of claim 10, further comprising a second dispenser flap in said top panel and defined at least in part by a second plurality of tear lines, said second dispenser flap being adjacent to said second handle flap.

16. A carton constructed from said blank of claim 10 and a plurality of pouches disposed within said carton.

* * * * *